US008632302B2

(12) United States Patent
Sorokes et al.

(10) Patent No.: US 8,632,302 B2
(45) Date of Patent: Jan. 21, 2014

(54) COMPRESSOR PERFORMANCE ADJUSTMENT SYSTEM

(75) Inventors: James M. Sorokes, Olean, NY (US); William C. Maier, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 627 days.

(21) Appl. No.: 12/632,412

(22) Filed: Dec. 7, 2009

(65) Prior Publication Data

US 2011/0135441 A1 Jun. 9, 2011

(51) Int. Cl.
*F04D 29/46* (2006.01)

(52) U.S. Cl.
USPC ..... 415/161; 415/165; 415/163; 415/164

(58) Field of Classification Search
USPC ..... 415/149.1, 160, 162, 163, 164, 165, 415/199.2, 199.3, 155, 161
See application file for complete search history.

(56) References Cited

U.S. PATENT DOCUMENTS

| | | | | |
|---|---|---|---|---|
| 3,489,339 | A * | 1/1970 | Greenwald | 415/163 |
| 3,930,746 | A | 1/1976 | Kronogard | |
| RE32,756 | E | 9/1988 | Mowill | |
| 4,768,921 | A | 9/1988 | Shinjiro et al. | |
| 4,932,835 | A | 6/1990 | Sorokes | |
| 5,100,308 | A | 3/1992 | Gevelhoff et al. | |
| 5,165,849 | A | 11/1992 | Nakagawa et al. | |
| 5,452,986 | A | 9/1995 | Osborne et al. | |
| 5,460,484 | A | 10/1995 | Yagi | |
| 5,730,580 | A * | 3/1998 | Japikse | 415/208.3 |
| 6,045,325 | A * | 4/2000 | Horvath et al. | 415/161 |
| 6,203,275 | B1 | 3/2001 | Kobayashi et al. | |
| 6,231,306 | B1 | 5/2001 | Khalid | |
| 6,607,353 | B2 * | 8/2003 | Masutani | 415/161 |
| 6,625,984 | B2 | 9/2003 | Gerke et al. | |
| 7,448,847 | B2 | 11/2008 | Lim | |
| 7,553,127 | B2 * | 6/2009 | Noelle | 415/164 |
| 2007/0166149 | A1 | 7/2007 | Tacconelli et al. | |
| 2010/0172745 | A1 | 7/2010 | Hodder | |

FOREIGN PATENT DOCUMENTS

| | | | |
|---|---|---|---|
| JP | 54-158547 | * | 12/1979 |
| JP | 56-72300 | * | 6/1981 |
| JP | 56072300 A | | 6/1981 |
| JP | 58093902 A | | 6/1983 |
| JP | 8-200289 | * | 8/1986 |
| JP | 2004144087 A | | 5/2004 |
| JP | 2009-150308 | * | 7/2009 |
| JP | 2009-264305 | * | 11/2009 |

OTHER PUBLICATIONS

Ichikawa, Multiple Stage Water Turbine, Dec. 14, 1979, Abstract of JP54-158547.*

(Continued)

*Primary Examiner* — Edward Look
*Assistant Examiner* — Liam McDowell

(57) ABSTRACT

A compressor performance adjustment system includes a compressor chassis defining an inlet passageway, a diffuser passageway coupled to the inlet passageway, and a return passageway extending from the diffuser passageway. At least one inlet vane is located in the inlet passageway. At least one diffuser vane is located in the diffuser passageway. At least one return vane is moveably coupled to the compressor chassis and located in the return passageway. The return vanes may be adjusted without disassembling the compressor chassis in order to adjust the flow incident on compressor components and adjust the performance of a compressor.

15 Claims, 19 Drawing Sheets

(56) References Cited

OTHER PUBLICATIONS

Kobayashi et al., Device for Driving Guide Vane of Multistage Centrifugal Compressor, Jun. 16, 1981, Abstract of JP56-72300.*
Nojima, Multistage Centrifugal Compressor, Aug. 6, 1996, Abstract of JP8-200289.*
Nakao, Centrifugal Compressor, Jul. 9, 2009, Abstract of JP2009-150308.*
Kawaguchi et al., Centrifugal Compressor and turbo Refrigerating Machine Using the Same, Nov. 12, 2009, Abstract of JP2009-264305.*
International Search Report and Written Opinion dated Aug. 26, 2011 (9 pages).

* cited by examiner

COMPRESSOR PERFORMANCE ADJUSTMENT SYSTEM

BACKGROUND

This disclosure relates in general to centrifugal compressors, and in particular to a performance adjustment system for a centrifugal compressor.

Conventional multi-stage centrifugal compressors are typically designed to provide the best possible performance at a 'design' operating condition, which may be, for example, a most common operating condition, an operating condition provided to design the compressor, and/or a variety of other design operating conditions known in the art. However, users of the compressor may require that the compressor provide optimized performance at an 'off-design' operating condition that is different from the design operating condition. In order to obtain such performance for off-design operating conditions, the user may be required to make adjustments in the various stationary components of compressors (e.g., the inlet guide vanes, the diffuser vanes, the return channel vanes, etc.). For example, changes in the vane setting angles may be implemented to investigate the compressors response to such changes in order to try to improve the overall performance of the compressor. In such cases, the compressor must be disassembled, new internal components may need to be fabricated to replace the original components, and/or various manual adjustments to the components may need to be made. Thus, the process of adjusting compressor performance for different operating conditions is very time-consuming and expensive.

Therefore, what is needed is an improved compressor performance adjustment system.

SUMMARY

Embodiments of the disclosure may provide a compressor performance adjustment system including a compressor chassis defining an inlet passageway, a diffuser passageway coupled to the inlet passageway, and a return passageway extending from the diffuser passageway, at least one inlet vane located in the inlet passageway, at least one diffuser vane located in the diffuser passageway, and at least one return vane moveably coupled to the compressor chassis and located in the return passageway.

Embodiments of the disclosure may provide a compressor performance adjustment system including a compressor chassis defining an inlet passageway, a diffuser passageway, and a return passageway, a plurality of return vanes moveably coupled to the compressor chassis and located in the return passageway, and an annular return vane actuation member coupled to each of the plurality of return vanes and operable to rotate about a return vane actuation member axis in order to move the plurality of return vanes relative to the compressor chassis.

Embodiments of the disclosure may provide a method for adjusting the performance of a compressor including providing a compressor chassis having at least one return vane located in a return passageway defined by the compressor chassis, and actuating a return vane actuation system to move the at least one return vane relative to the compressor chassis.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
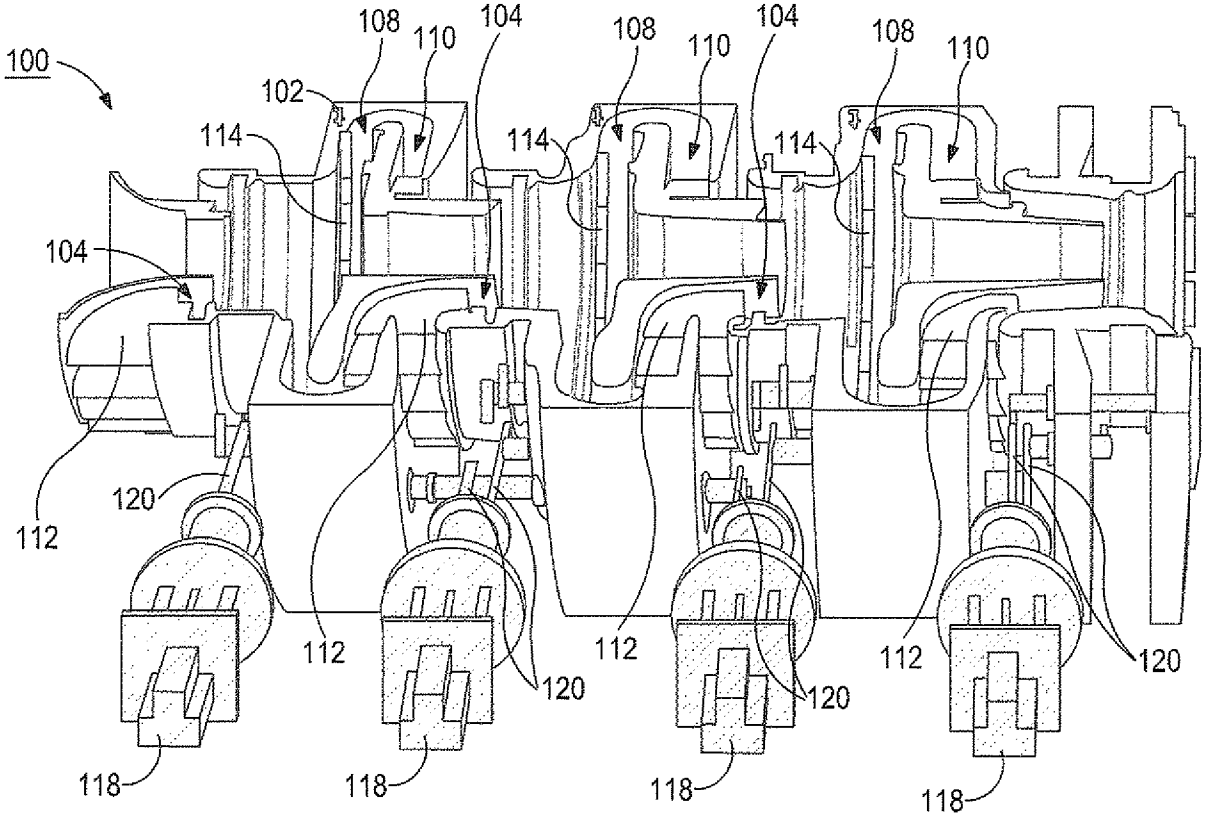
FIG. 1*a* is a cut-away perspective view illustrating an exemplary embodiment of a compressor chassis.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

Figure 1B:
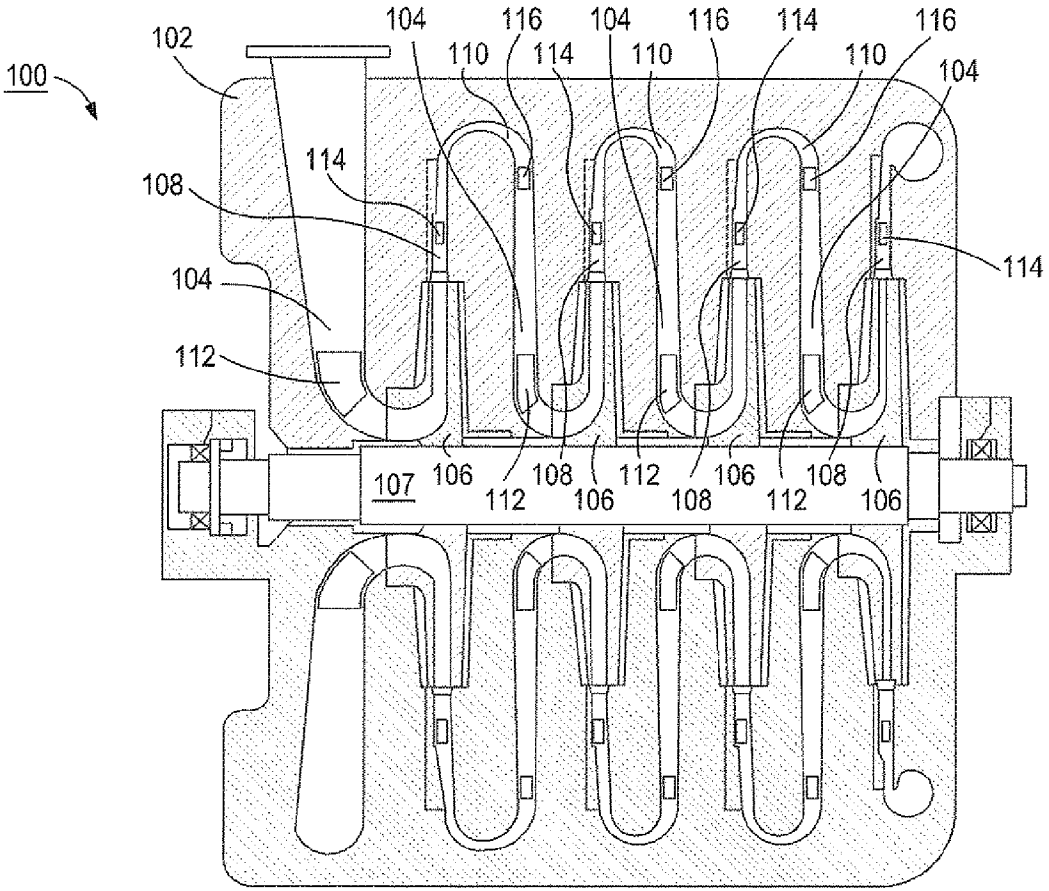
FIG. 1*b* is a cross-sectional view illustrating the embodiment of the compressor chassis of FIG. 1*a*.
Figure 1C:
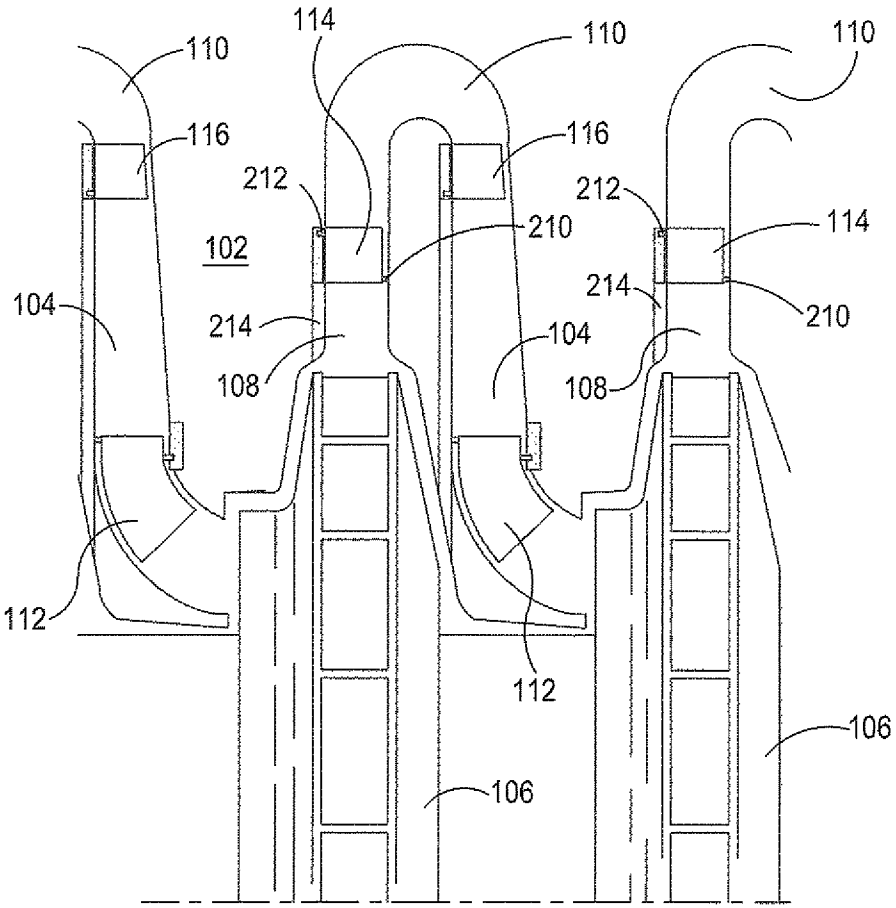
FIG. 1*c* is a cross-sectional view illustrating the embodiment of the compressor chassis of FIGS. 1*a* and 1*b*.

Referring now to FIGS. 1*a*, 1*b*, and 1*c*, an exemplary embodiment of a compressor performance adjustment system 100 is illustrated. The compressor adjustment system 100 can include a compressor chassis 102 that defines a plurality of inlet passageways 104. In the illustrated embodiment, the inlet passageways 104 are circular in cross section. A plurality of impellers 106 are mounted to a shaft 107 that is rotatably coupled to the compressor chassis 102 such that each of the impellers 106 is located adjacent a respective inlet passageway 104. The compressor chassis 102 also defines a plurality of diffuser passageways 108 that extend from a location adjacent a respective impeller 106. In the illustrated embodiment, the plurality of diffuser passageways 108 are circular in cross section. The compressor chassis 102 also defines a plurality of return passageways 110 that extend between a respective diffuser passageway 108 and a respective inlet passageway 104. In the illustrated embodiment, the plurality of return passageways 110 are circular in cross section. A plurality of inlet vanes 112 can be moveably coupled to the compressor chassis 102 and located in each of the inlet passageways 104 (e.g., in the illustrated embodiment, in a spaced apart orientation from each other about the circular cross section of each of the inlet passageways 104). A plurality of diffuser vanes 114 can be moveably coupled to the compressor chassis 102 and located in each of the diffuser passageways 108 (e.g., in the illustrated embodiment, in a spaced apart orientation from each other about the circular cross section of each of the diffuser passageways 108). A plurality of return vanes 116 can be moveably coupled to the compressor chassis 102 and located in each of the return passageways 110 (e.g., in the illustrated embodiment, in a spaced apart orientation from each other about the circular cross section of each of the return passageways 110). A plurality of actuator pods 118 can be coupled to the compressor chassis 102 (and to the inlet vanes 112, the diffuser vanes 114, and the return vanes 116, as will be described in further detail below) through a plurality of actuator rods 120.

Figure 2A:
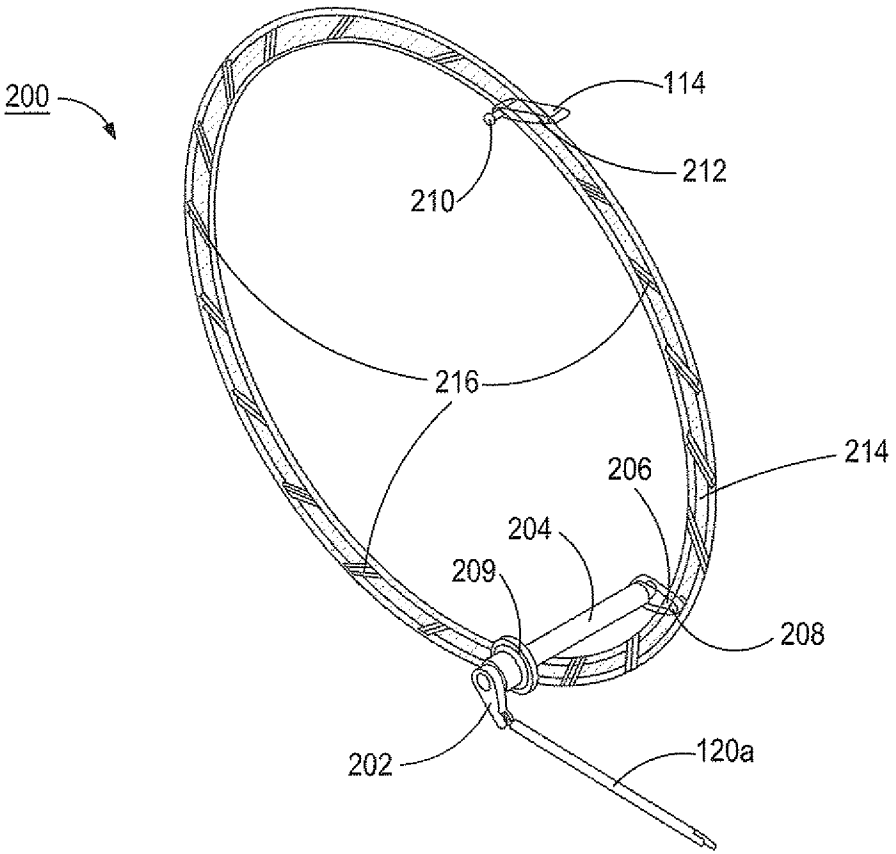
FIG. 2*a* is a perspective view illustrating an exemplary embodiment of a diffuser vane actuation system used with the compressor chassis of FIGS. 1*a*, 1*b*, and 1*c*.
Figure 2B:
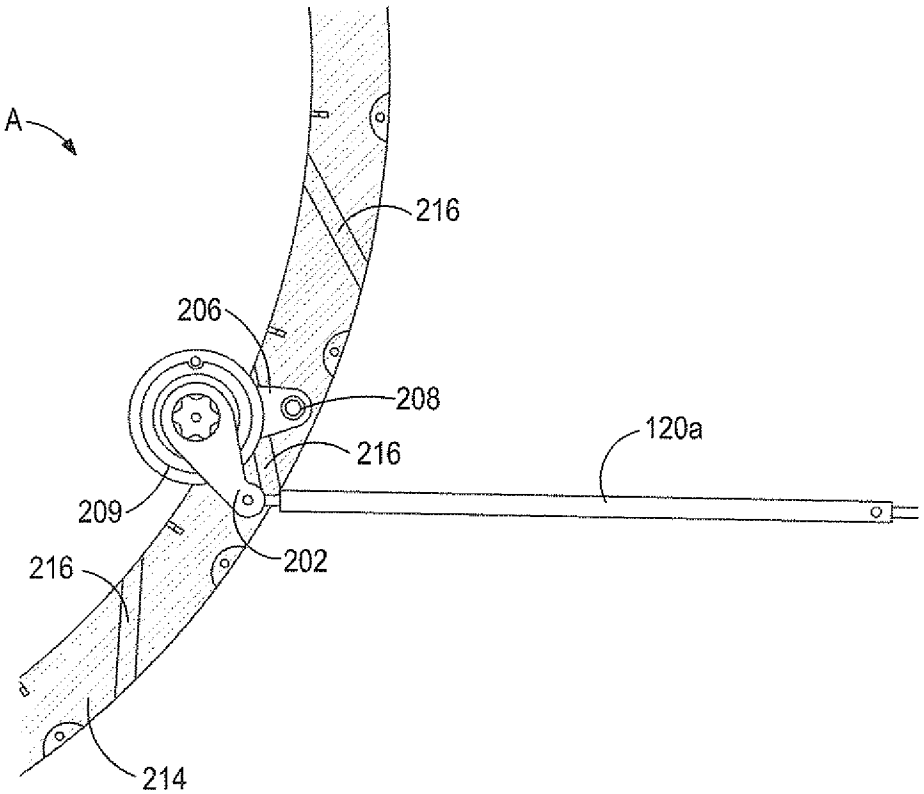
FIG. 2*b* is a side view illustrating the embodiment of the diffuser vane actuation system of FIG. 2*a*.
Figure 2C:
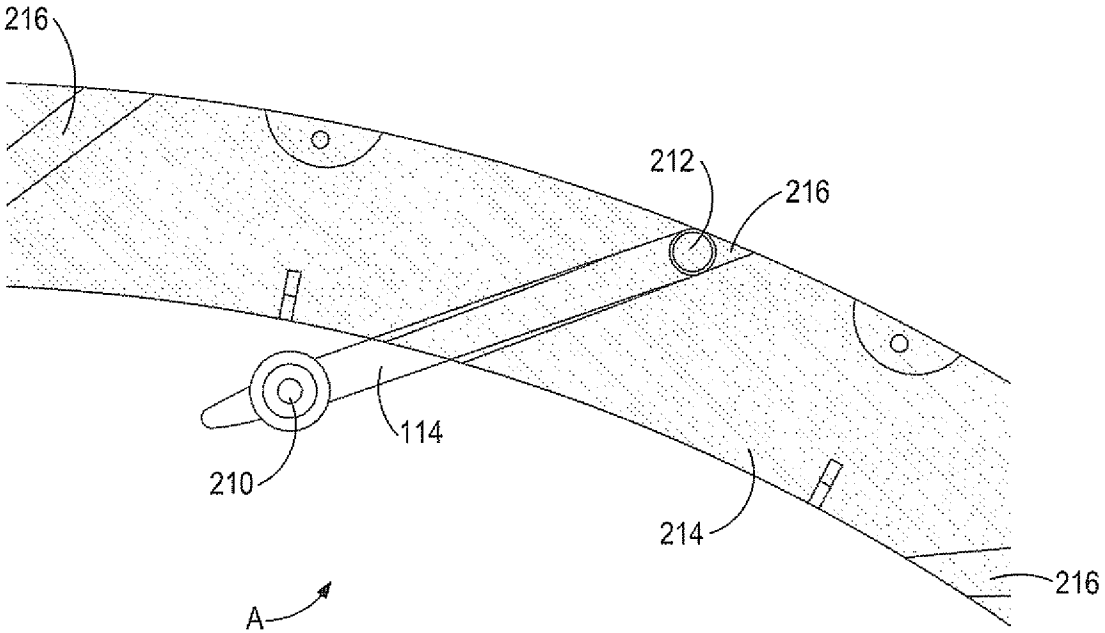
FIG. 2*c* is another side view illustrating the embodiment of the diffuser vane actuation system of FIG. 2*a*.
Figure 3A:
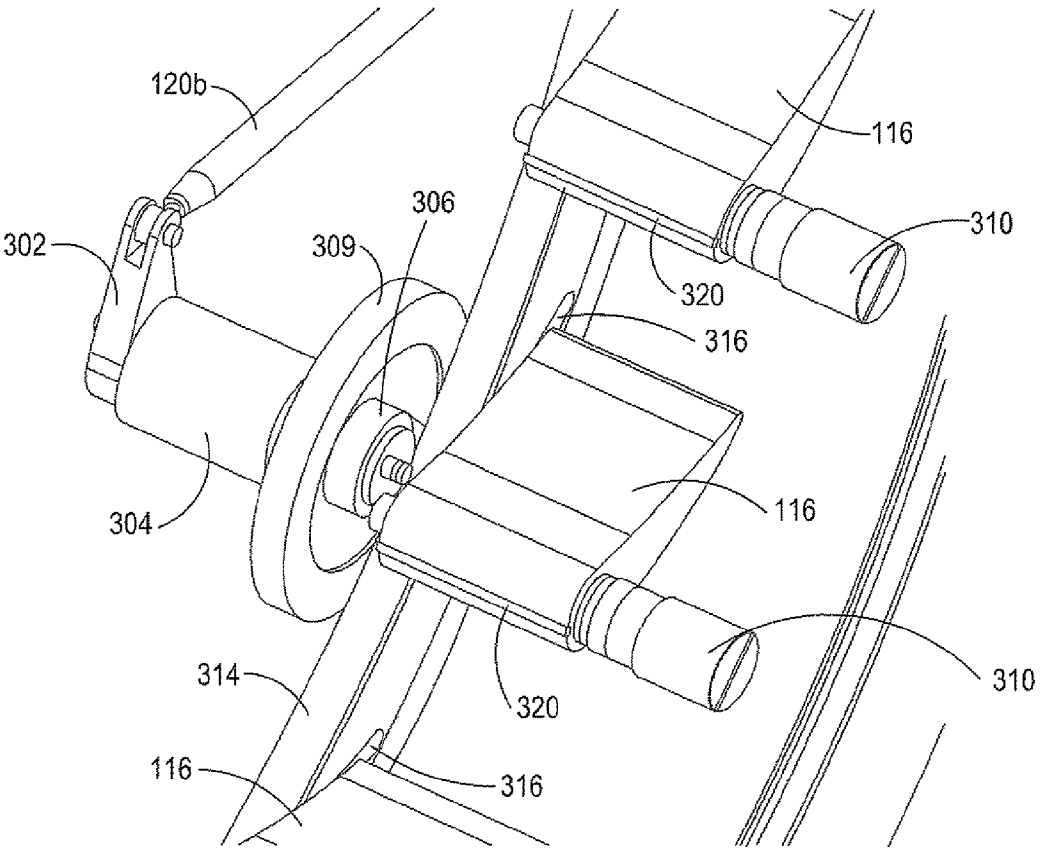
FIG. 3*a* is a perspective view illustrating an exemplary embodiment of a return vane actuation system used with the compressor chassis of FIGS. 1*a*, 1*b*, and 1*c*.
Figure 3B:
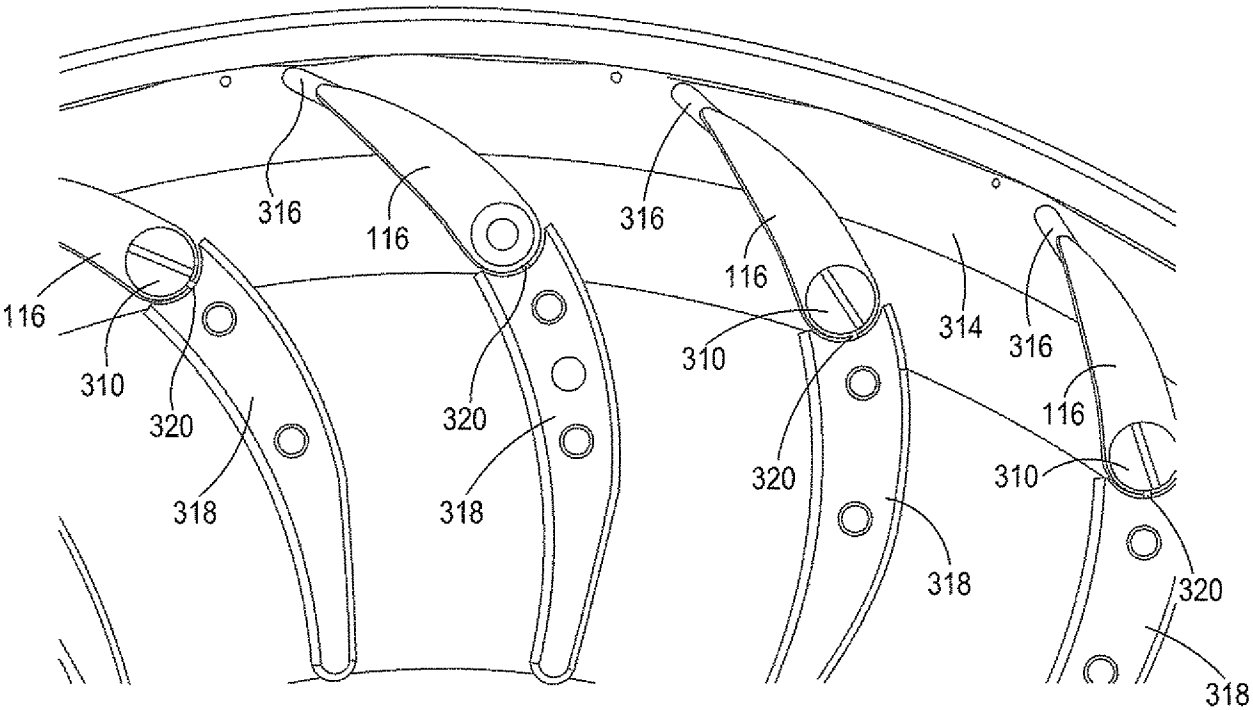
FIG. 3*b* is a side view illustrating the embodiment of the return vane actuation system of FIG. 3*a*.
Figure 3C:
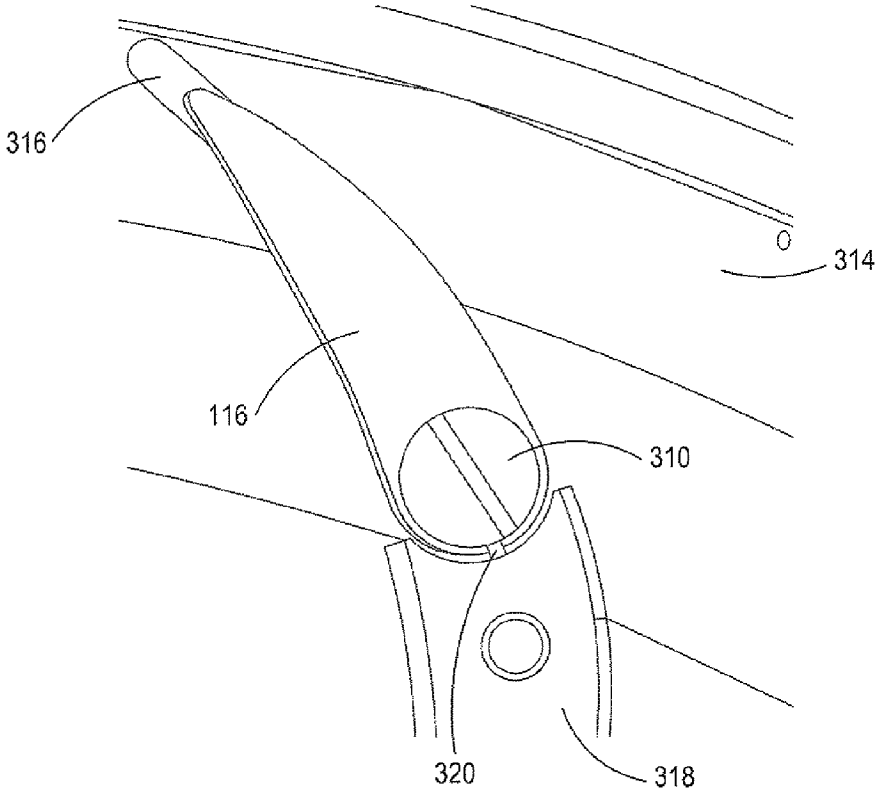
FIG. 3*c* is another side view illustrating the embodiment of the return vane actuation system of FIG. 3*a*.
Figure 3D:
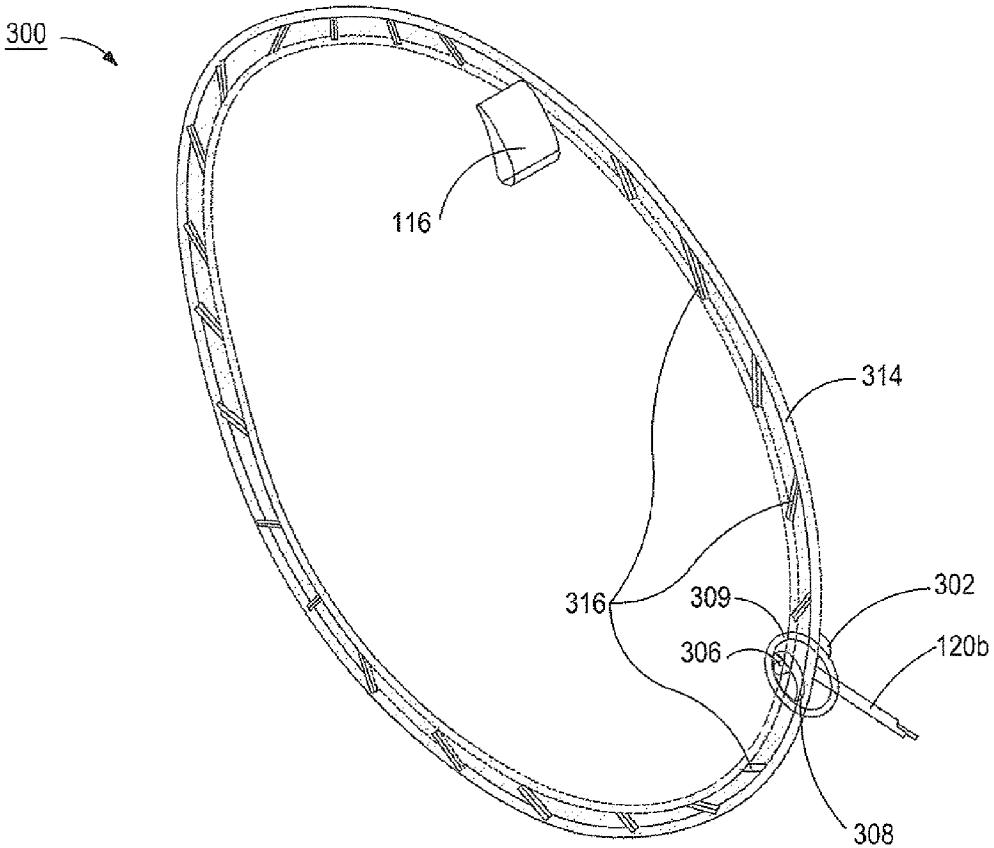
FIG. 3*d* is a perspective view illustrating the embodiment of the return vane actuation system of FIG. 3*a*.
Figure 3E:
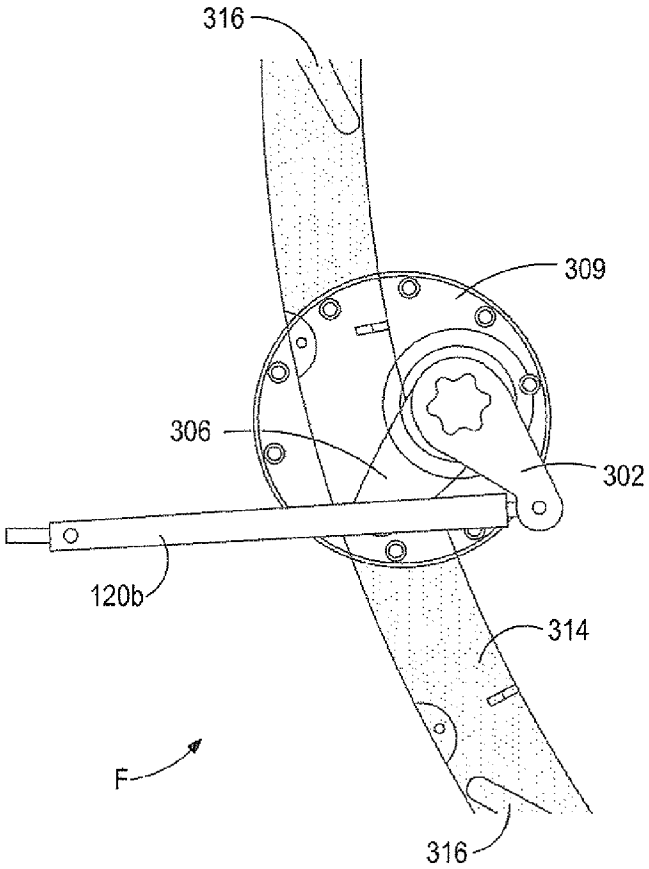
FIG. 3*e* is a side view illustrating the embodiment of the return vane actuation system of FIG. 3*a*.
Figure 3F:
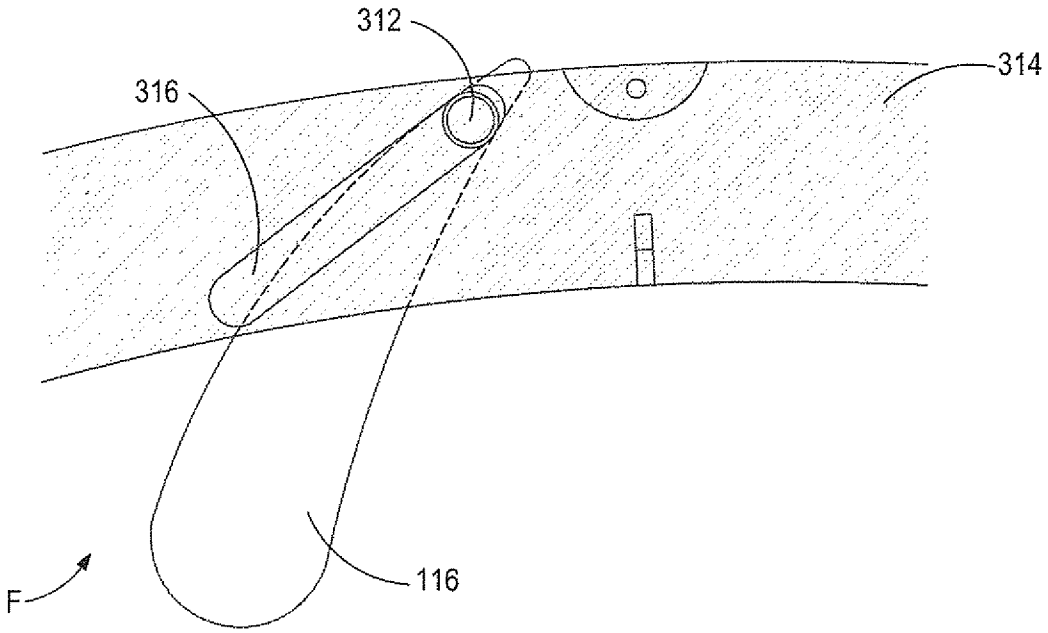
FIG. 3*f* is another side view illustrating the embodiment of the return vane actuation system of FIG. 3*a*.

Referring now to FIGS. 1*a*, 1*c*, 2*a*, 2*b*, and 2*c*, an example of the coupling of the actuator pods 118 to the diffuser vanes 114 will be described and illustrated in more detail. FIGS. 2*a*, 2*b*, and 2*c* illustrate an exemplary diffuser vane actuation system 200, including an actuator rod 120*a* that extends from one of the actuator pods 118. The actuator rod 120*a* is pivotally coupled to a first arm 202 that is mounted to a distal end of a translation rod 204. A second arm 206 that includes an actuation pin 208 is mounted to a distal end of the translation rod 204 such that it is opposite the first arm 202. In an embodiment, the translation rod 204 is rotatably coupled to the compressor chassis 102 through a bearing 209 that allows the translation rod 204 to rotate about its axis. Each diffuser vane 114 is rotatably coupled to the compressor chassis 102 by a diffuser vane coupling 210 and also includes a diffuser vane pin 212 extending from an end of the diffuser vane 114 that is opposite the diffuser vane coupling 210. In an exemplary embodiment, an annular diffuser vane actuation member 214 is located adjacent each diffuser passageway 108 and is coupled to the actuation rod 120*a* through the actuation pin 208. The annular diffuser vane actuation member 214 defines a plurality of actuation channels 216 circumferentially offset from each other around the body of the annular diffuser vane actuation member 214 in a spaced apart orientation from each other. Each diffuser vane pin 212 on each diffuser vane 114 is located in a respective actuation channel 216 on the annular diffuser vane actuation member 214, as illustrated in FIG. 2*a*. While FIG. 2*a* illustrates a single diffuser vane 114 for clarity, one of skill in the art will recognize that a plurality of diffuser vanes 114 may be coupled to the annular diffuser vane actuation member 214 through the actuation channels 216 in the same manner as the illustrated diffuser vane 114.

Referring now to FIGS. 1*a*, 1*c*, 3*a*, 3*b*, 3*c*, 3*d*, 3*e*, and 3*f*, the coupling of the actuator pods 118 to the return vanes 116 will be described and illustrated in more detail. FIGS. 3*a*, 3*b*, 3*c*, 3*d*, 3*e*, and 3*f* illustrate an exemplary diffuser vane actuation system 300 including an actuator rod 120*b* that extends from one of the actuator pods 118. The actuator rod 120*b* is pivotally coupled to a first arm 302 that is mounted to a distal end of a translation rod 304. A second arm 306 that includes an actuation pin 308 is mounted to a distal end of the translation rod 304 such that it is opposite the first arm 302. In an exemplary embodiment, the translation rod 304 is rotatably coupled to the compressor chassis 102 through a bearing 309 that allows the translation rod 304 to rotate about its axis. Each return vane 116 is rotatably coupled to the compressor chassis 102 by a return vane coupling 310 and also includes a return vane pin 312 (FIG. 3*d*), extending from an end of the return vane 116 that is opposite the return vane coupling 310. An annular return vane actuation member 314 is located adjacent each return passageway 110 and is coupled to the actuation rod 120*b* through the actuation pin 306. The annular return vane actuation member 314 defines a plurality of actuation channels 316 circumferentially offset from each other around the body of the annular return vane actuation member 314 in a spaced apart orientation from each other. Each return vane pin 312 on each return vane 116 is located in a respective actuation channel 316 on the annular return vane actuation member 314. In an embodiment, illustrated in FIGS. 3*b* and 3*c*, a stationary vane portion 318 is located adjacent to and spaced apart from each of the return vanes 116, and a seal 320 is positioned between each return vane 116 and its adjacent stationary vane portion 318. While the stationary vane portion 318 and seal 320 are only being illustrated for the return vane actuation system 300, in other embodiments, similar components may be included with the diffuser vane actuation system 200, described above with reference to FIGS. 2*a*, 2*b*, and 2*c*, and/or the inlet vane actuation system 400, described below with reference to FIG. 4.

Figure 4:
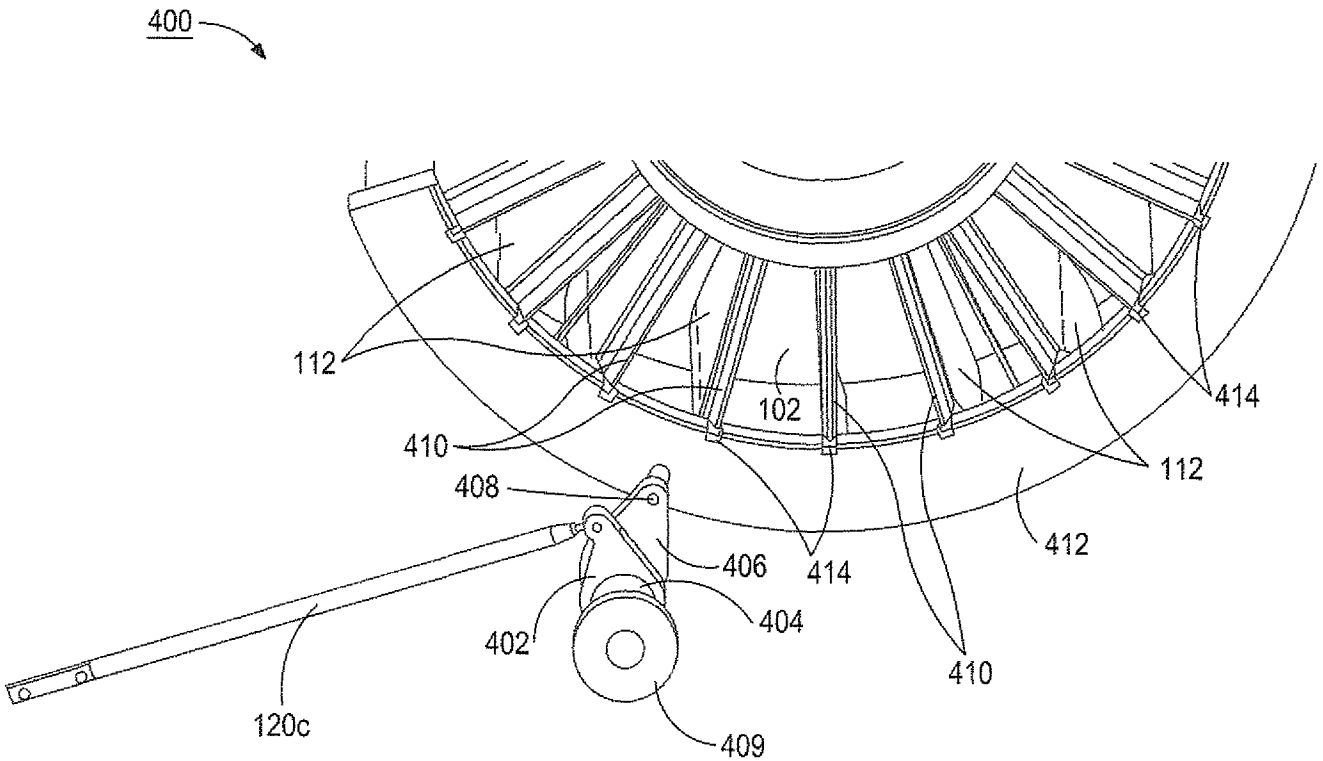
FIG. 4 is a perspective view illustrating an exemplary embodiment of an inlet vane actuation system used with the compressor chassis of FIGS. 1*a*, 1*b*, and 1*c*.

Referring now to FIGS. 1*a*, 1*c*, and 4, an example of the coupling of the actuator pods 118 to the inlet vanes 112 will be described and illustrated in more detail. FIG. 4 illustrates one of a plurality of inlet vane actuation systems 400, each including one of the actuator rods 120*c* that extend from each actuator pod 118. The actuator rod 120*c* is pivotally coupled to a first arm 402 that is mounted to a translation rod 404. A second arm 406, including an actuation pin 408, is mounted to a distal end of the translation rod 404 in a spaced apart orientation from the first arm 402. In an embodiment, the translation rod 404 is rotatably coupled to the compressor chassis 102 through a bearing 409 that allows the translation rod 404 to rotate about its axis. Each inlet vane 112 that is pivotally coupled to the compressor chassis 102 and also includes a inlet vane pin 410 on an end of the inlet vane 112 that is opposite the pivotal coupling to the compressor chassis 102. An annular inlet vane actuation member 412 is located adjacent each inlet passageway 104 and is configured to be manipulated by to the actuation rod 120*c*. The annular inlet vane actuation member 412 defines a plurality of actuation channels 414 circumferentially offset from each other around the body of the annular inlet vane actuation member 412 in a spaced apart orientation from each other. Each inlet vane pin 410 on each inlet vane 112 is located in a respective actuation channel 414 on the annular inlet vane actuation member 412.

Figure 5A:
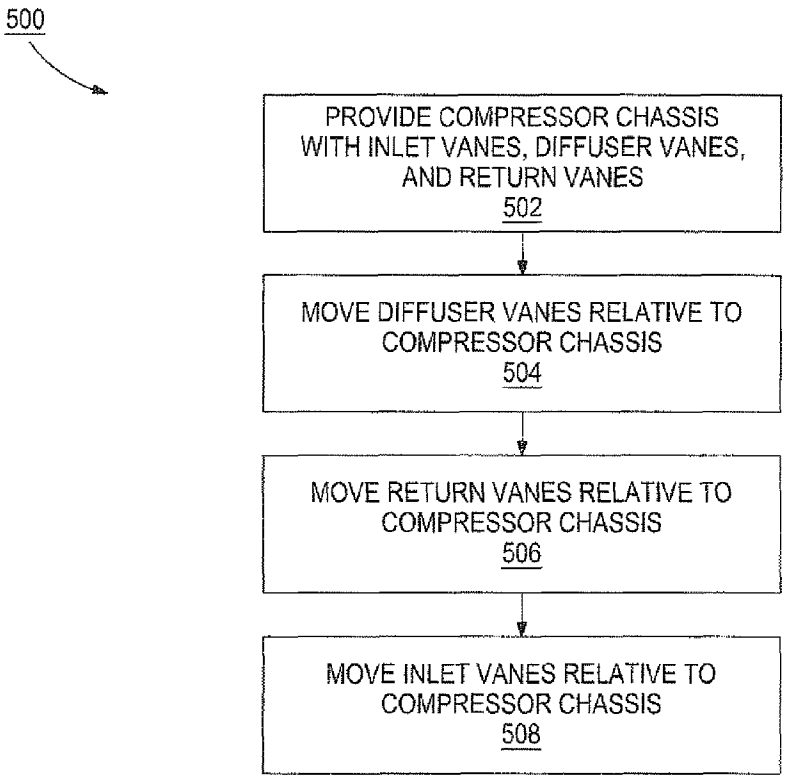
FIG. 5*a* is a flow chart illustrating an exemplary embodiment of a method for adjusting the performance of a compressor.
Figure 5B:
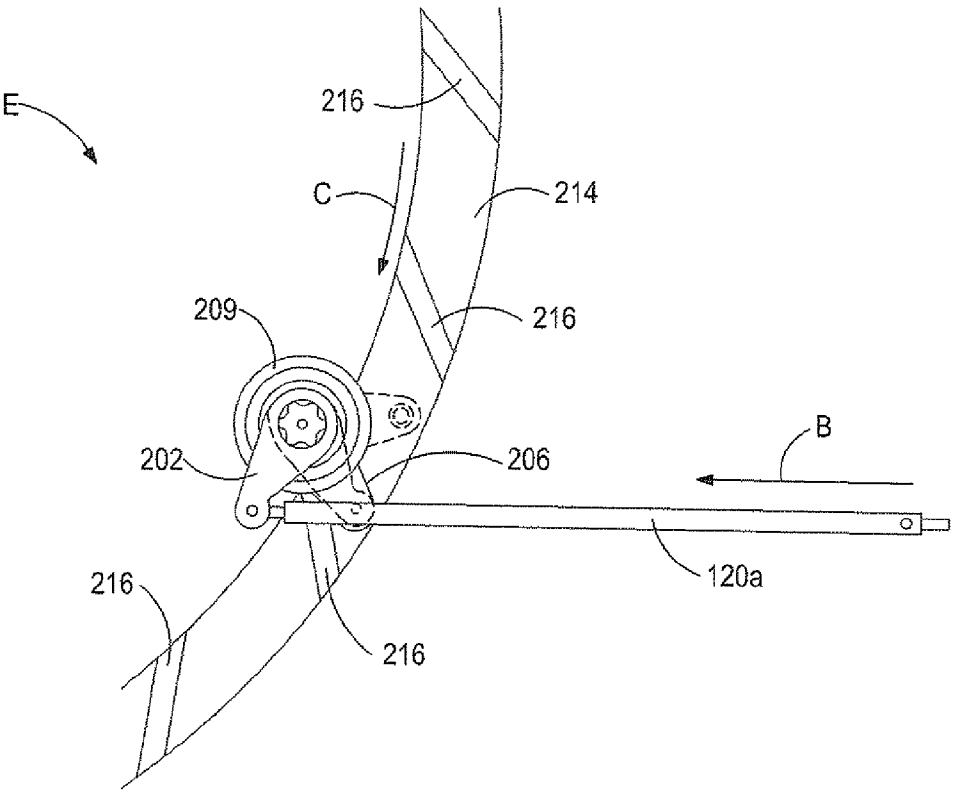
FIG. 5*b* is a side view illustrating the embodiment of the diffuser vane actuation system of FIGS. 2*a*, 2*b*, and 2*c* moving from a first orientation to a second orientation.
Figure 5C:
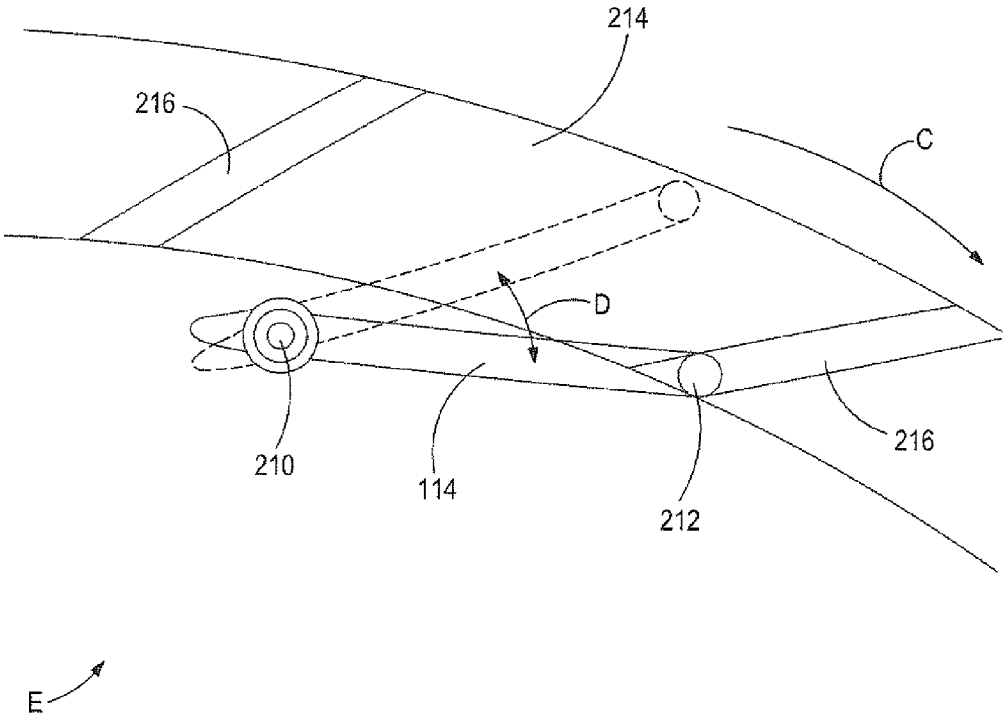
FIG. 5*c* is another side view illustrating the embodiment of the diffuser vane actuation system of FIGS. 2*a*, 2*b*, and 2*c* moving from a first orientation to a second orientation.
Figure 5D:
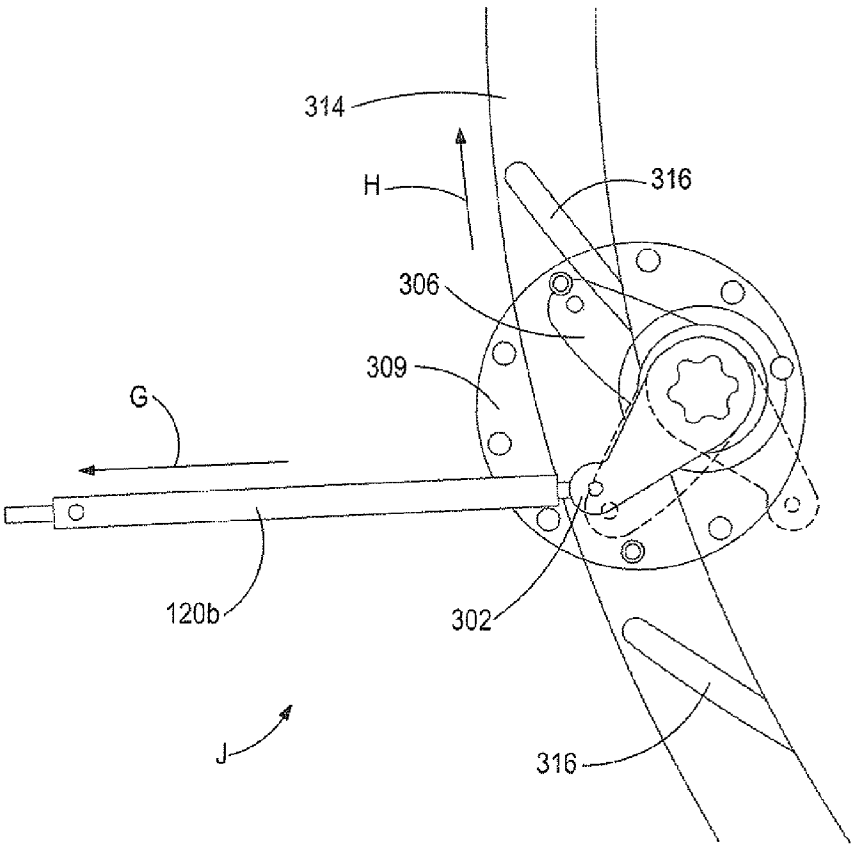
FIG. 5*d* is a side view illustrating the embodiment of the return vane actuation system of FIGS. 3*a*, 3*b*, 3*c*, and 3*d* moving from a first orientation to a second orientation.

Referring now to FIGS. 2*a*, 2*b*, 2*c*, 5*a*, 5*b*, and 5*c*, an exemplary method 500 for adjusting the performance of a compressor is illustrated. The method 500 can begin at block 502 where a compressor chassis with inlet vanes, diffuser vanes, and return vanes is provided. In an exemplary embodiment, the compressor chassis 102 including the plurality of inlet vanes 112 located in each of the inlet passageways 104, the plurality of diffuser vanes 114 located in each of the diffuser passageways 108, and the plurality of return vanes 116 located in each of the return passageways 110, described above with reference to FIGS. 1*a*, 1*b*, and 1*c*, is provided. The method 500 can then proceed to block 504 where the diffuser vanes are moved relative to the compressor chassis. As described above with reference to FIGS. 2*a*, 2*b*, and 2*c*, the plurality of diffuser vanes 114 located in each diffuser passageway 108 can be coupled to the annular diffuser vane actuation member 214. In an exemplary embodiment, the diffuser vane actuation system 200 may begin in a first orientation A, as illustrated in FIGS. 2*b* and 2*c*. The actuator pod 118 may then be used to actuate the actuator rod 120*a* and move the actuator rod 120*a* in a direction B, as illustrated in FIG. 5*b*, which causes the translation rod 204 to rotate about its axis due to its coupling with the first arm 202. In various exemplary embodiments, the actuator rod 120*a* may be moved hydraulically, pneumatically, mechanically, manually, and/or in a variety of other manners known in the art. Rotation of the translation rod 204 about its axis causes the second arm 206 to move the annular diffuser vane actuation member 214 in a direction C as it rotates about its axis. As the annular diffuser vane actuation member 214 moves in the direction C, each of the diffuser vanes 114 that are coupled thereto will rotate about the diffuser vane coupling 210 and through an angle D due to the diffuser vane pin 212 being located in the actuation channel 216, as illustrated in FIG. 5*c*. In block 504 of the method 500, the diffuser vane actuation system 200 may be moved from the orientation A, illustrated in FIGS. 2*b* and 2*c*, into an orientation E, illustrated in FIGS. 5*b* and 5*c*. In an embodiment, the angle D that the diffuse vanes move through from the orientation A to the orientation E may be about 10 degrees. However, one of skill in the art will recognize that the angle D may be adjusted, for example, by adjusting the geometry of the diffuser vane actuation system 200, without departing from the scope of the present disclosure.

Figure 5E:
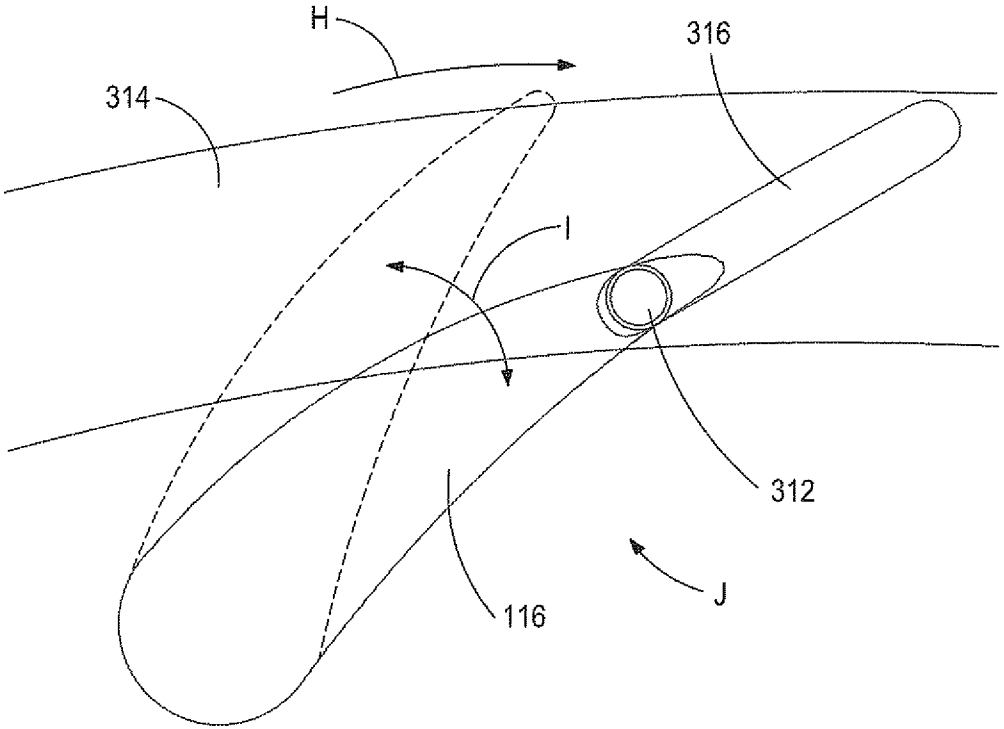
FIG. 5*e* is another side view illustrating the embodiment of the return vane actuation system of FIGS. 3*a*, 3*b*, 3*c*, and 3*d* moving from a first orientation to a second orientation.

Referring now to FIGS. 3*a*, 3*b*, 3*c*, 3*d*, 5*a*, 5*d*, and 5*e*, the method 500 can then proceed to block 506 where the return vanes 116 are moved relative to the compressor chassis 102. As described above with reference to FIGS. 3*a*, 3*b*, 3*c*, and 3*d*, the plurality of return vanes 116 can be coupled to the annular return vane actuation member 314. In an embodiment, the return vane actuation system 300 may begin in a first orientation F, illustrated in FIGS. 3*c* and 3*d*. The actuator pod 118 may then be used to actuate the actuator rod 120*b* and move the actuator rod 120*b* in a direction G, illustrated in FIG. 5*d*, which causes the translation rod 304 to rotate about its axis due to its coupling to the first arm 302. In an embodiment, the actuator rod 120*b* may be moved hydraulically, pneumatically, mechanically, manually, and/or in a variety of other manners known in the art. Rotation of the translation rod 304 about its axis causes the second arm 306 to move the annular return vane actuation member 314 in a direction H as it rotates about its axis. As the annular return vane actuation member 314 moves in the direction H, each of the return vanes 116 will rotate about the return vane coupling 310 and through an angle I due to the return vane pin 312 being located in the actuation channel 316, as illustrated in FIG. 5*e*. In block 506 of the method 500, the return vane actuation system may be moved from the orientation F, illustrated in FIGS. 3*c* and 3*d*, into an orientation J, illustrated in FIGS. 5*d* and 5*e*. In an exemplary embodiment, the angle I that the diffuse vanes move through from the orientation F to the orientation J may be about 10 degrees. However, one of skill in the art will recognize that the angle I may be adjusted, for example, by adjusting the geometry of the diffuser vane actuation system 200, without departing from the scope of the present disclosure. In an embodiment, the seal 320 prevents fluid from moving between the return vanes 116 and their adjacent stationary vane portions 318 and causing disturbances in the fluid flow and result in excess losses.

Figure 5F:
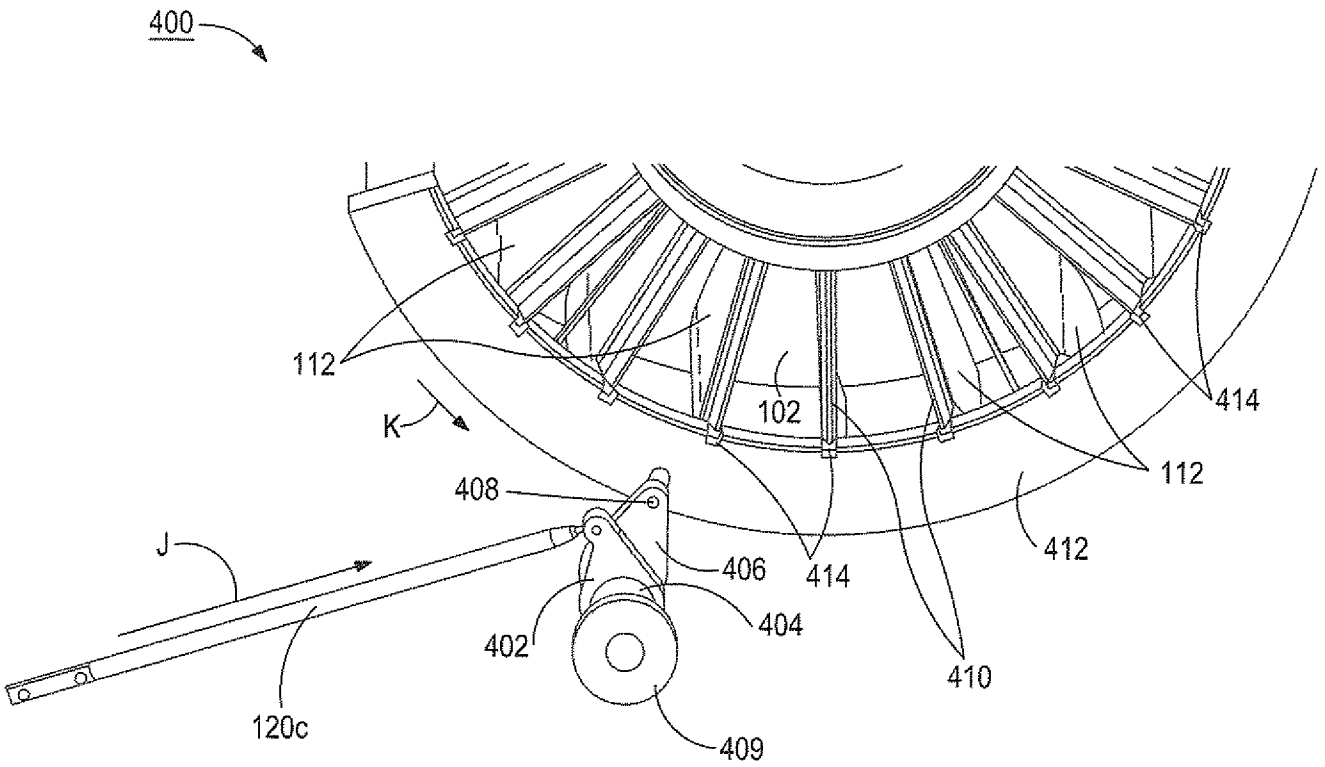
FIG. 5*f* is a perspective view illustrating the embodiment of the inlet vane actuation system of FIG. 4 moving from a first orientation to a second orientation.

Referring now to FIGS. 5*a* and 5*f*, the method 500 can then proceed to block 508 where the inlet vanes are moved relative to the compressor chassis. As described above with reference to FIG. 4, the plurality of inlet vanes 112 can be coupled to the annular inlet vane actuation member 412. The actuator pod 118 may be used to actuate the actuator rod 120*c* and move the actuator rod 120*c* in a direction J (FIG. 5*f*) which causes the translation rod 404 to rotate about its axis due to its coupling to the first arm 402. In an embodiment, the actuator rod 120*c* may be moved hydraulically, pneumatically, mechanically, manually, and/or in a variety of other manners known in the art. Rotation of the translation rod 404 about its axis causes the second arm 406 to move the annular inlet vane actuation member 412 in a direction K as it rotates about its axis. As the annular inlet vane actuation member 412 moves in the direction K, each of the inlet vanes 112 that are coupled to the annular inlet vane actuation member 412 will pivot about their coupling to the compressor chassis 102 due to the inlet vane pin 410 being located in the actuation channel 414, as illustrated in FIG. 5*f*.

Thus, a compressor is provided that allows the inlet vanes, the diffuser vanes, and the return vanes to be adjusted without the need to disassemble the compressor, fabricate new parts, or make any manual internal adjustments. Peak attainable efficiency and wide operating range for conventional compressors are, to a great extent, mutually exclusive characteristics. For example, a vaneless compressor will yield a wider operating range, but will not achieve a performance level as high as a vaned design. Inlet vanes, diffuser vanes, and return vanes have a large effect on both efficiency and range, and the ability to adjust these vanes allows the user to 'tune' the compressor by optimizing the flow incident on compressor components for a wide range of operating conditions. Doing so without disassembly of the compressor saves time and effort in optimizing the compressor for a particular operating condition. Furthermore, the impact of alternate vane angles on overall flow range and/or peak efficiency may be assessed and optimized for increased performance, and a matrix of vane angles may be produced an a relatively short cycle time relative to conventional compressors such that the data may be analyzed to determine the best combination of vane angles for any given application.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A compressor performance adjustment system, comprising:

a compressor chassis defining an inlet passageway, a diffuser passageway coupled to the inlet passageway, and a return passageway extending from the diffuser passageway;

at least one inlet vane located in the inlet passageway;

at least one diffuser vane located in the diffuser passageway;

a plurality of return vanes located in the return passageway;

an annular return vane actuation member coupled to each of the plurality of return vanes and operable to rotate about a return vane actuation member axis in order to move the plurality of return vanes relative to the compressor chassis;

a plurality of actuation channels defined by the annular return vane actuation member and located about the circumference of the annular return vane actuation member, each return vane of the plurality of return vanes being located in a respective actuation channel of the plurality of actuation channels via a return vane pin extending from each return vane of the plurality of return vanes;

a first actuator rod pivotally coupled to a first arm and the first actuator rod configured to rotate the annular return vane actuation member about the return vane actuation member axis;

a translation rod having a first end thereof coupled to the first arm; and a second arm coupled to a second end of the translation rod opposite the first end and the second arm coupled to the annular return vane actuation member via an actuation pin.

2. The system of claim 1, further comprising:

a plurality of inlet vanes located in the inlet passageway; and an annular inlet vane actuation member coupled to each of the plurality of inlet vanes and operable to rotate about an inlet vane actuation member axis in order to move the plurality of inlet vanes relative to the compressor chassis.

3. The system of claim 2, further comprising:

a second actuator rod coupled to the annular inlet vane actuation member and operable to rotate the annular inlet vane actuation member about the inlet vane actuation member axis.

4. The system of claim 1, further comprising:

a plurality of diffuser vanes located in the diffuser passageway; and an annular diffuser vane actuation member coupled to each of the plurality of diffuser vanes and operable to rotate about a diffuser vane actuation member axis in order to move the plurality of diffuser vanes relative to the compressor chassis.

5. The system of claim 4, further comprising:

a second actuator rod coupled to the annular diffuser vane actuation member and operable to rotate the annular diffuser vane actuation member about the diffuser vane actuation member axis.

6. The system of claim 1, further comprising:

an actuator pod comprising the first actuator rod, a second actuator rod operable to move the at least one inlet vane relative to the compressor chassis, and a third actuator rod operable to move the at least one diffuser vane relative to the compressor chassis.

7. A compressor performance adjustment system, comprising:

a compressor chassis defining an inlet passageway, a diffuser passageway, and a return passageway;

a plurality of return vanes moveably coupled to the compressor chassis and located in the return passageway;

an annular return vane actuation member coupled to each of the plurality of return vanes and operable to rotate about a return vane actuation member axis in order to move the plurality of return vanes relative to the compressor chassis;

a plurality of actuation channels defined by the annular return vane actuation member and located about the circumference of the annular return vane actuation member, each return vane of the plurality of return vanes being located in a respective actuation channel of the plurality of actuation channels via a return vane pin extending from each return vane of the plurality of return vanes;

an actuator rod pivotally coupled to a first arm and the actuator rod configured to rotate the annular return vane actuation member about the return vane actuation member axis;

a translation rod having a first end thereof coupled to the first arm; and a second arm coupled to a second end of the translation rod opposite the first end and the second arm coupled to the annular return vane actuation member via an actuation pin.

8. The system of claim 7, further comprising:

an actuator pod coupled to the actuator rod and operable to move the actuator rod in order to rotate the annular return vane actuation member.

9. The system of claim 7, wherein each return vane pin is located in a respective actuation channel on the annular return vane actuation member.

10. The system of claim 7, further comprising:

a stationary vane portion located adjacent each return vane.

11. The system of claim 10, further comprising:

a seal located between each return vane and the stationary vane portion located adjacent that return vane.

12. The system of claim 7, wherein the plurality of return vanes are operable to move relative to the compressor chassis through an angle of 10 degrees.

13. A method for adjusting the performance of a compressor, comprising:

providing a compressor chassis comprising a plurality of return vanes located in a return passageway defined by the compressor chassis; and actuating a return vane actuation system, the return vane actuation system comprising an actuator rod pivotally coupled to a first arm, a translation rod having a first end thereof coupled to the first arm, and a second arm coupled to a second end of the translation rod opposite the first end and the second arm coupled to an annular return vane actuation member via an actuation pin, the return vane actuation system being actuated by rotating the annular return vane actuation member about a return vane actuation member axis using the actuator rod, the annular return vane actuation member being coupled to each return vane of the plurality of return vanes to move the plurality of return vanes relative to the compressor chassis, the annular return vane actuation member defining a plurality of actuation channels located about the circumference of the annular return vane actuation member, and each return vane of the plurality of return vanes being located in a respective actuation channel of the plurality of actuation channels via a return vane pin extending from each return vane of the plurality of return vanes.

14. The method of claim 13, wherein at least one inlet vane is located in a inlet passageway defined by the compressor chassis, an inlet vane actuation system comprises an annular inlet vane actuation member coupled to the at least one inlet vane, and the method further comprises:

actuating the inlet vane actuation system to rotate the annular inlet vane actuation member about an inlet vane actuation member axis in order to move the at least one inlet vane relative to the compressor chassis.

15. The method of claim 13, wherein at least one diffuser vane is located in a diffuser passageway defined by the compressor chassis, a diffuser vane actuation system comprises an annular diffuser vane actuation member coupled to the at least one diffuser vane, and the method further comprises:

actuating the diffuser vane actuation system to rotate the annular diffuser vane actuation member about a diffuser vane actuation member axis in order to move the at least one diffuser vane relative to the compressor chassis.

* * * * *